United States Patent [19]

Hosbein

[11] 4,133,435

[45] Jan. 9, 1979

[54] WIRE CARRYING SPOOL AND APPARATUS FOR SUPPORT AND LIFTING THEREOF

[75] Inventor: Hugh W. Hosbein, Fort Wayne, Ind.

[73] Assignee: Mossberg Hubbard a Division of Wanskuck Company, Garrett, Ind.

[21] Appl. No.: 822,874

[22] Filed: Aug. 8, 1977

[51] Int. Cl.[2] ..... B66F 3/00

[52] U.S. Cl. ..... 214/1 D; 214/130 C; 214/DIG. 4; 254/8 R

[58] Field of Search ..... 214/1 D, 130 R, 130 C, 214/332, 380, 381, DIG. 4; 254/8 R, 113, 120, 131

[56] References Cited

U.S. PATENT DOCUMENTS

| | | | |
|---|---|---|---|
| 143,222 | 9/1873 | Cokly | 214/130 R X |
| 1,442,267 | 1/1923 | Gross et al. | 214/130 R X |
| 1,471,695 | 10/1923 | Kelley et al. | 254/8 R X |
| 1,525,589 | 2/1925 | Noffsinger | 254/120 X |

*Primary Examiner*—L. J. Paperner

*Attorney, Agent, or Firm*—Gust, Irish, Jeffers & Rickert

[57] ABSTRACT

A spool having an elongated barrel has a strap supported at one end at a bottom flange on the barrel with the strap passing upwardly therethrough out of the upper end thereof. The strap is removably attached to the bottom flange. A handle is affixed to the strap portion which extends beyond the upper end of the spool. A rigid frame having an upright portion is affixed to a base supported by casters. The frame has a member rigidly affixed to and transversely extending from the upper end of the upright portion which overhangs the spool. A lever having a transverse portion near one end is pivotally connected at the distal end of the transverse portion to the frame member. An arm is pivotably secured at one end to the upright portion and at the other end is engageable with the spool handle. A link is pivotably connected between said arm and the transverse portion to provide a toggle linkage. A downward force applied to the end of the lever serves to lift the arm and the spool by means of the engagement between the arm and the handle whereas an upward force lowers the spool. The toggle linkage serves to lock the spool in the lifted position.

6 Claims, 8 Drawing Figures

WIRE CARRYING SPOOL AND APPARATUS FOR SUPPORT AND LIFTING THEREOF

BACKGROUND OF THE INVENTION

1. Field of the Invention

This invention is in the field of wire carrying spools of the kind whereon wire, such as magnet wire, is wound in layers upon the spool for storing, transporting, and dispensing, and also to the field of apparatus which may be manually operated to lift the spool from a transporting pallet for manipulation to a spool-using position.

2. Description of the Prior Art

It is common practice in the industry to wind wire about the outer diameter of a spool barrel in successive layers to provide for storage, transport, and dispensing at the use station of the wire, for example at a motor coil-winding machine. Typically, the wire is wound on a spool at a wire-manufacturing station or site, the spool then placed on a shipping pallet, which is a flat box-like structure having an open end for receiving the forks of a fork-lift truck or the like, is placed in a transporting vehicle, and is removed from the vehicle at a storage or use location or site. It is necessary then to remove the spool from the pallet and place it in suitable apparatus for unwinding the wire from the spool in connection with fabricating magnetic devices.

In the past, handles have been provided on one end of the spools for manually carrying and positioning the spools. However, when the spools are of a weight exceeding one hundred pounds, manual transport becomes difficult and cumbersome.

SUMMARY OF THE INVENTION

A spool construction is provided having a sturdy extendible handle member connected centrally thereof and adapted for spool transport with minimum spool tilt and sway. The spool in upright position has a barrel portion having upper and lower flanges with a strap-supporting member being attached to the lower flange. A strap is secured at one end to the first member and extends upwardly through the top of the spool. The strap then is passed back downwardly through the spool for attachment to the strap-supporting member. A handle is securely attached to the strap portion which extends above the spool. A relatively inexpensive, sturdy frame has a handle engaging arm to which a lifting force may be applied through a toggle linkage. The frame is provided with casters rotatably mounted to a base portion thereof for transporting relatively heavy spools over a floor surface after lifting the spool from a supporting pallet.

A frame has an upright member and a transversely extending base supported on said casters for moving the base under the spool-carrying pallet. The upright member has an arm rigidly attached to the upper portion thereof and extending transversely therefrom to overhang the base. Pivoted to the end of the arm is the end of a transverse portion of an elongated lever. A lifting arm is pivotally connected to the upper end of the upright member with the distal end being engagable with the spool handle to suspend the spool therefrom. A link is pivoted at one end to an intermediate portion of the lifting arm adjacent to such distal end and at the other end to the transverse portion of said lever at a point spaced from the pivotal connection with said overhanging arm.

With a spool positioned on a pallet into which the base is inserted, and the end of the lifting arm is inserted beneath the handle, downward swinging movement of the handle will result in swinging the lifting arm upwardly thereby elevating the spool off the pallet. Opposite movement of the lever will result in lowering the spool onto the pallet. The combination of the aforesaid link and the transverse end portion of the lever constitute a toggle linkage. This linkage coupled with the length of the lever provides a mechanical advantage to facilitate lifting a heavy spool. Further, the toggle linkage is so arranged that it locks overcenter when the lever is moved to the limit of its downward movement. Thus, the frame may be transported over a floor surface to carry the spool therewith without the further application of any manual holding or force being applied to the lever.

When the spool has been transported to the desired location, the operator simply lifts the lever with the toggle thereby unlocking to lower the spool onto a supporting surface. Due to the spool handle construction, the lifting action is not accompanied by spool tilting or swaying, thereby resulting in a safer, and more facile spool transport and placement.

It is therefore an object of this invention to provide a lifting device for a spool whereby the latter may be efficiently, reliably and safely transported.

It is a further object of this invention to provide in the construction of the previous object a handle which is attached to the spool in such a manner as to minimize the spool tilt and swaying during the lifting and transporting of a spool.

It is a still further object of this invention to provide an apparatus for lifting a spool by means of the aforementioned handle and to hold it suspended by means of a toggle device moved to overcenter position.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 8:
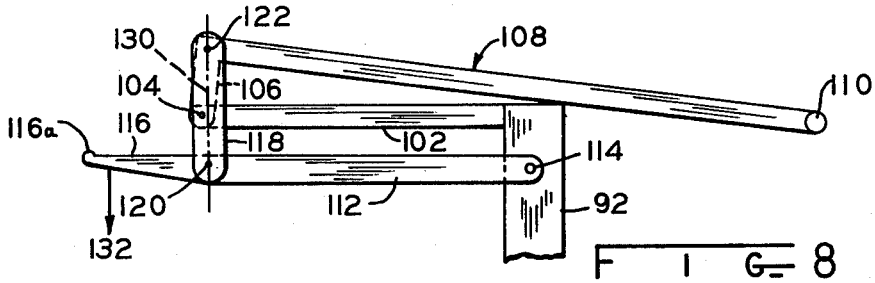
FIG. 8 is an enlarged partial view of the lifting lever mechanism of the apparatus of FIGS. 5–7.
Figure 2:
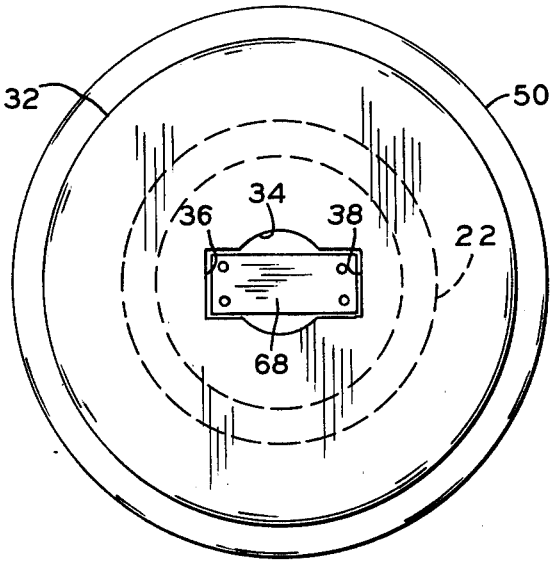
FIG. 2 is a top plan view of the embodiment of FIG. 1.
Figure 1:
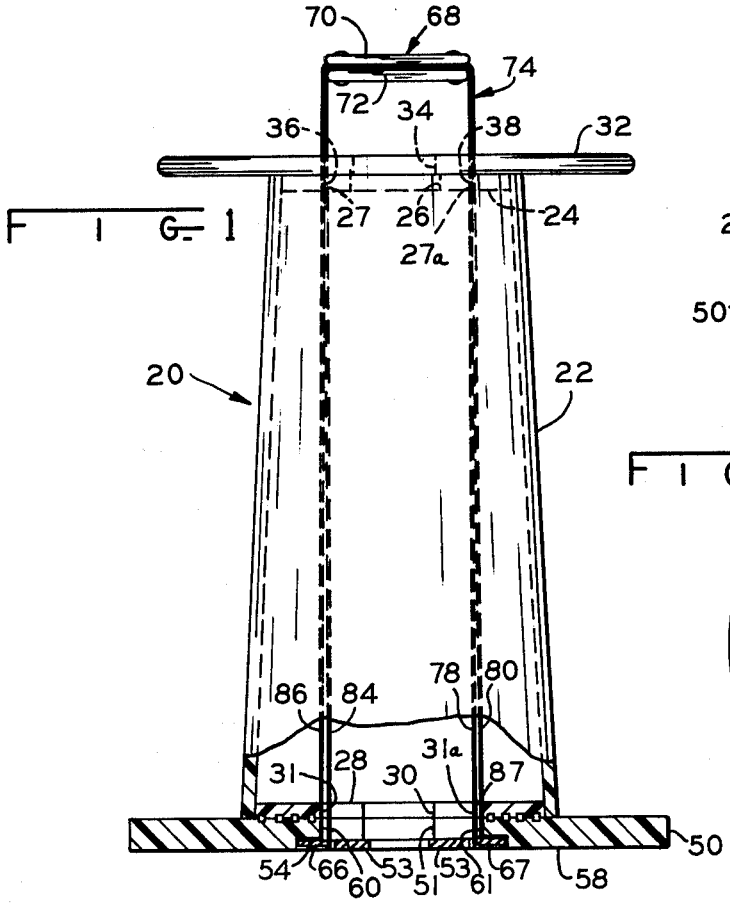
FIG. 1 is a side view of one embodiment of this invention partially sectioned for clarity of illustration.
Figure 3:
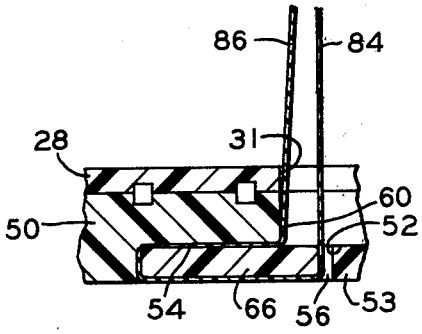
FIG. 3 is an enlarged partial view of the handle strap-connecting means of the embodiment of FIG. 1.
Figure 4:
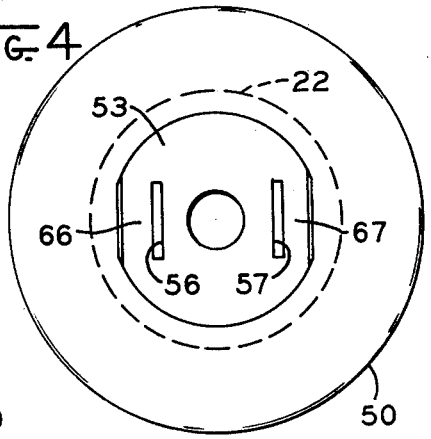
FIG. 4 is a bottom view of the embodiment of FIG. 1.
Figure 5:
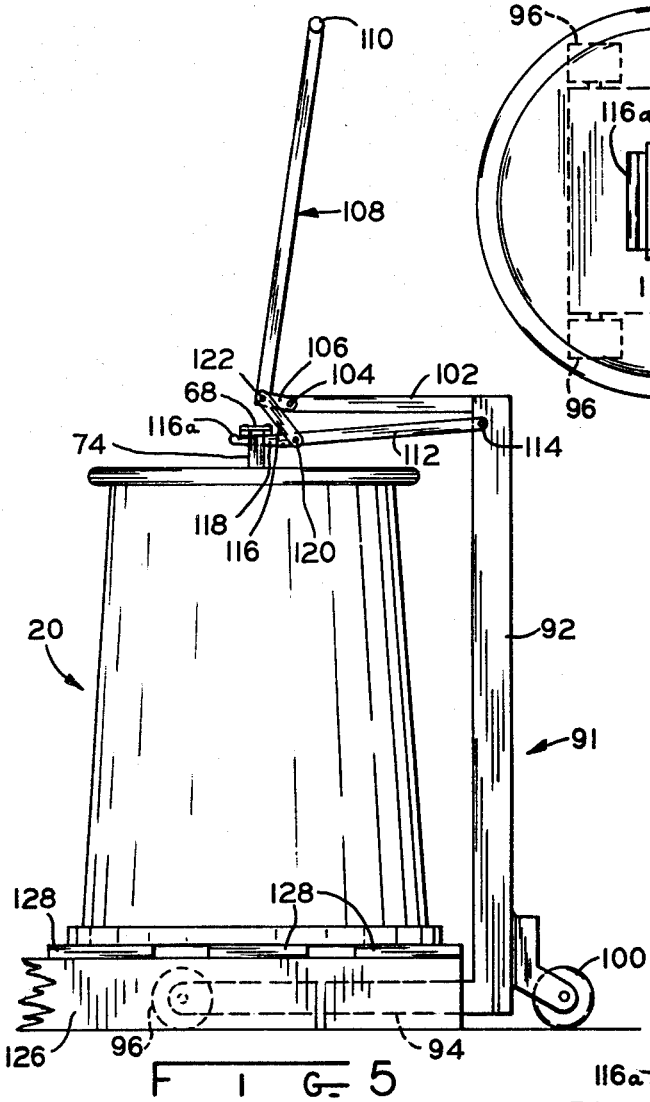
FIG. 5 is a side view of an embodiment of the lifting apparatus of this invention in operative combination with the spool of the preceding figures.
Figure 7:
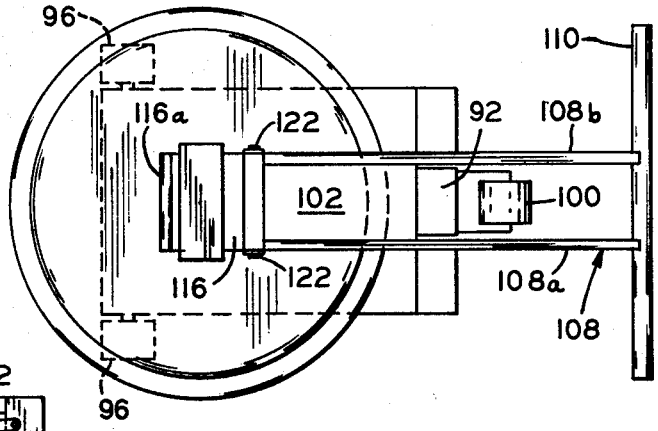
FIG. 7 is a top plan view of the embodiment of FIG. 6.
Figure 6:
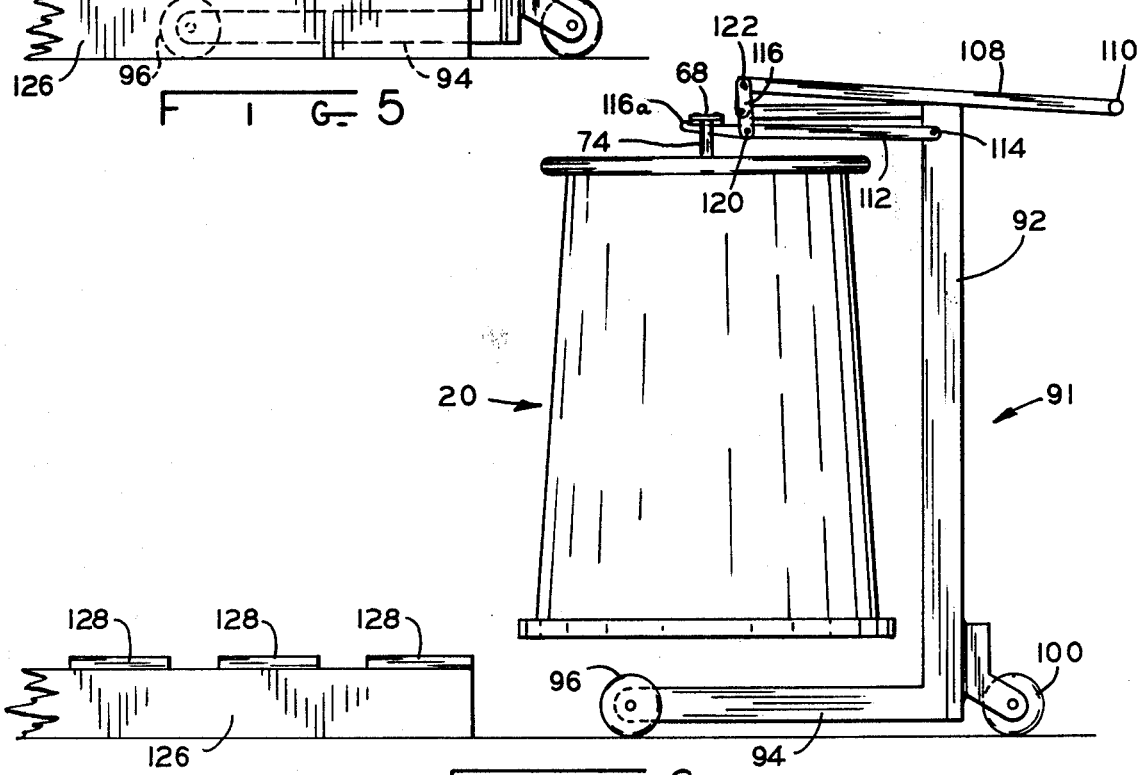
FIG. 6 is a side view of the embodiment of FIG. 5 operated to lift a spool to an elevation above a supporting pallet.

Referring to the drawings and more particularly to FIGS. 1 to 4, a wire carrying spool 20 has an elongated, tapered barrel 22 provided with a disc shaped end plate 24 secured in the upper end thereof. End plate 24 is provided with a generally circular coaxial central opening 26, opening 26 having diametrically opposed oblong recesses 27, 27*a* formed therein. A bottom end plate 28 is secured in the lower end of barrel 22 and has a generally circular, coaxial opening 30 provided with diametrically opposed, oblong recesses 31, 31*a*. An upper spool flange 32 is attached to the upper end of barrel 22 coaxially to overlie end plate 24. This flange 32 is formed with an opening having a circular portion 34 and recesses 36 and 38 which are congruent and in registry with opening 26, 27, 27*a*.

Attached to the lower end of barrel 22 is bottom flange 50 having formed centrally thereof an opening 51 also having diametrically opposed oblong recesses 60, 61. Opening 51 is substantially of the same size and shape and is disposed in registry with opening 30.

A coaxial annular recess 54 is provided in the bottom of flange 50 which removably receives a retaining ring 53 having diametrically opposed slots 56 and 57. Ring portions 66 and 67 are thus defined between the slots 56 and 57, respectively, and the perimeter of ring 53 for a purpose explained later. The ring 53 when mounted in recess 54 defines a surface flush with the bottom of flange 50.

A device for lifting and suspending the spool generally is in the form of a metallic strap or band 74 that is removably attached to the bottom flange 50 and extends upwardly through the barrel interior and upper flange 32 where it is provided with a handle 68. The strap in one form is essentially a closed loop flattened to form two adjacent parallel band portions laced through the spool as will now be explained.

Beginning at the spool bottom, one retaining-ring portion 66 has two band portions 78 and 80, (FIG. 3) passed thereabout, one band portion 78 passing through slot 56. Both portions 78 and 80 pass upwardly through the barrel interior, through the oblong recesses 61, 31*a*, 27*a*, and 38. It will be noted that the path defined by the ends of these recesses and slot is substantially straight. At a position spaced above flange 32, the band portions 78, 80 and the adjacent band ends are clamped between two rigid bar elements 70 and 72 which conjointly form a handle 68. These elements 70 and 72 are secured together by means of threaded fasteners or rivets as may be desired which also secure the band portions thereto.

The strap 74, composed of band portions 84 and 86, then passes through the barrel 22 via the end of recesses 36, 27, 31 and 60 where the band portions 84 and 86 encircle the other retaining-ring portion 67, band portion 84 passing through slot 57.

With the retaining ring 53 nested in the recess 54 (FIGS. 1 and 4), the handle 68 may be grasped to lift the spool 20. Disassembly of the handle 68 and attached strap 74 from the spool is simply accomplished by withdrawing the retaining ring 53 from the companion recess 54 and pulling the strap 74 downwardly (as viewed in FIG. 1), through and out of the barrel, the handle 68 passing through the various slot shaped openings in the barrel end plates 24, 28 and flanges 32, 50.

As clearly shown, the lifting strap 74 and handle 68 are centrally and symmetrically attached to the spool 20 such that the spool suspends truly upright and stable when lifted thereby. The retaining ring 53 requires no means for fastening it to the flange 50 other than an intimate press fit with the recess 54.

Referring to FIGS. 5, 6, 7, and 8, a manually operable lifting truck 91 to lift a fully loaded spool 20 is shown. This truck 91 is of simple construction, provides a mechanical advantage sufficient to lift a loaded spool, and provides a toggle linkage to lock the spool in lifted position, whereby a loaded spool may be conveniently transported over a floor surface.

A rigid supporting frame 91 has an upright 92 mounted on a horizontal base 94 supported by three casters 96 and 100. A horizontal supporting arm or bar 102 is secured at one end to the upper end of upright 92 to overhand base 94. An operating lever assembly 108 is angled at one end to provide a crank arm of transverse portion 106, which in the illustrated embodiments extends at right angles to the longer portion of lever assembly 108. This lever assembly 108 further includes two like rigid elements 108*a* and 108*b* secured in parallel, spaced relation at one end by means of a handle 110 and a pivotal connection to opposite sides of arm 102 at 104. Two, spaced, parallel, lifting arms 112 are pivoted at 114 to opposite sides of upright 92 just beneath the supporting arm 102 as shown. At the opposite ends, arms 112 have a transverse lifting plate 116 provided with an upwardly rounded lip 116*a* for insertion under and retaining engagement with handle 68.

A pair of toggle links 118, also spaced and parallel, are first pivotally connected at one end 120 to the two arms 112, respectively, and at the other end to the angles 122, respectively, formed between the lever portions 106 and the longer portions of lever elements 108*a*, 108*b*. Since lever 108 is pivotally connected to supporting arm 102, swinging movement thereof raises and lowers correspondingly the lifting arms 112 through the connecting links 118. Also, the links 118 conjointly with the transverse lever portions 106 form a toggle linkage which locks overcenter when lever assembly 108 is swung to its extreme horizontal position shown in FIG. 8, thereby to hold lifting arms 112 in their uppermost position. Swinging lever assembly 108 upright to its position of FIG. 5, lowers arms 112 to their lowermost position.

Operation of the lifting truck 91 will now be described. Loaded spools 20 are conventionally shipped on transporting pallets open at opposite ends made of transverse strips 126 and 128 of wood. With a spool 20 loaded thereon, the truck 91 is manipulated to roll the base 94 through an end of the pallet 126, 128 to a position beneath spool 20. The lifting pad or plate 116 is inserted under the handle 68, and the lever assembly is swung downwardly to its position of FIG. 8. The handle 68 is thus raised, lifting spool 20 therewith and from pallet 126, 128. The toggle linkage 106, 118 being overcenter holds the spool 20 in lifted position. The truck 91 is then manually withdrawn from the pallet and rolled to a desired location for storage or use. If desired, the handle 68 and its carrying straps are then removed from the spool 20. By reason of the relatively short length of transverse lever portion 106, a substantial mechanical advantage is provided for lifting spools 20 which when loaded can weigh several hundred pounds.

Referring further to FIG. 8, the toggle linkage is shown in the lifted, overcenter, locked position. In this position, the lifting force to the spool 20 is maintained without the requirement of any further downward force on handle 110. This toggle linkage, in locked position has center line 130 which connects pivots 122 and 120 overcenter or to the right of pivot 104. In this position, the spool weight represented by arrow 132 on plate 116 applies a downward force to pivot 122 through links 118. This in turn applies a clockwise "holding" moment to pivot 122 about pivot 104. This moment maintains lever assembly 108 in its lifting position without any further force being applied to handle 110. Thus, the lifted spool may be easily transported by grasping handle 110 and rolling truck 91 to a desired location. The spool may be lowered by lifting handle 110 to overcome the holding moment.

While there have been described above the principles of this invention in connection with specific apparatus, it is to be clearly understood that this description is made only by way of example and not as a limitation to the scope of the invention.

What is claimed is:

1. A manually operable lifting mechanism comprising a supporting frame having a horizontal base portion provided with an upright portion and a horizontal supporting arm portion rigidly secured at one end to the upper end of said upright portion to overhang said base portion, a lifting lever disposed above said supporting arm portion and being pivotally connected at one end to the outer end portion of said supporting arm portion for swinging movement between first and second positions, said second position disposing said lever above and in substantial parallelism with said supporting arm portion and said first position disposing said lever above said supporting arm portion at an angle thereto, a load-lifting arm pivotally connected at one end to said upright portion beneath said supporting arm portion in substantial parallelism with the latter to extend substantially horizontally, and means connecting said lifting lever to said pivoted arm at a location spaced from the distal end of said pivoted arm for swinging said pivoted arm upwardly and downwardly when said lifting lever is swung between its first and second positions, respectively.

2. The mechanism of claim 1 wherein said means includes a toggle linkage which locks overcenter when said lifting lever is moved to its first position and unlocking when said lever is moved to its second position.

3. The mechanism of claim 2 wherein said base is supported on wheels, and said lifting lever is provided with a handle which may be grasped to move said mechanism over a supporting surface.

4. The mechanism of claim 2 wherein said lifting lever is provided with a transverse portion at its pivoted end which serves as one link of said toggle linkage, a second link pivotally connected at its opposite ends between said pivoted arm and said lifting lever which serves as the other link of said toggle linkage.

5. A manually operable lifting mechanism comprising a supporting frame having a horizontal base portion provided with an upright portion and a horizontal supporting arm portion secured at one end to the upper end of said upright portion to overhang said base portion, a manually operable lifting lever pivotally connected at one end to the outer end portion of said supporting arm portion for swinging movement between first and second positions, a load-lifting arm pivotally connected at one end to said upright portion near said supporting arm portion to extend substantially horizontally, said lever having a first link portion at its pivoted end extending substantially at right angles thereto, a second link pivotally connected between said lever at the angle formed with said first link portion and said pivoted arm, said pivot connection between said second link and said pivoted arm being near the distal end of the latter whereby the moment arm of said pivoted arm between said upright portion and said pivot connection is longer than the moment arm of said link portion between said pivot connection at said angle and the connection of said pivoted arm to said supporting arm portion, said pivoted arm extending substantially parallel to said lifting lever, said first link portion and said second link locking overcenter when said lifting lever is moved to its first position and unlocking when said lever is moved to its second position.

6. The mechanism of claim 5 wherein said lifting lever in its first position overlies in substantial parallelism said supporting arm portion and said pivoted arm, said lifting lever extending beyond said upright frame portion, said lifting lever serving to raise and lower the distal end of said pivoted arm with respect to said base when moved between said first and second positions, respectively.

* * * * *